US008669215B2

(12) United States Patent
Randles et al.

(10) Patent No.: US 8,669,215 B2
(45) Date of Patent: Mar. 11, 2014

(54) GEAR OIL ADDITIVE

(75) Inventors: Stephen James Randles, Middlesbrough (GB); Stephen Boyde, Guisborough (GB); Josephine Anne Lefevre, Middlesbrough (GB)

(73) Assignee: Croda International PLC, Goole, East Yorkshire (GB)

( * ) Notice: Subject to any disclaimer, the term of this patent is extended or adjusted under 35 U.S.C. 154(b) by 0 days.

(21) Appl. No.: 13/132,688

(22) PCT Filed: Nov. 27, 2009

(86) PCT No.: PCT/GB2009/002765

§ 371 (c)(1), (2), (4) Date: Jul. 12, 2011

(87) PCT Pub. No.: WO2010/063989

PCT Pub. Date: Jun. 10, 2010

(65) Prior Publication Data

US 2011/0269655 A1 Nov. 3, 2011

(30) Foreign Application Priority Data

Dec. 5, 2008 (GB) ..... 0822256.4

(51) Int. Cl.
*C10M 129/78* (2006.01)

(52) U.S. Cl.
USPC ..... 508/459

(58) Field of Classification Search
USPC ..... 508/459
See application file for complete search history.

(56) References Cited

U.S. PATENT DOCUMENTS

| | | | | |
|---|---|---|---|---|
| 3,390,083 | A | 6/1968 | Lion | |
| 5,314,634 | A * | 5/1994 | Kenbeek et al. | 508/492 |
| 5,503,762 | A * | 4/1996 | Bongardt et al. | 508/481 |
| 2005/0049153 | A1* | 3/2005 | Zehler et al. | 508/492 |
| 2005/0090410 | A1* | 4/2005 | Devlin et al. | 508/438 |
| 2007/0000807 | A1* | 1/2007 | Wu et al. | 208/18 |
| 2007/0254818 | A1 | 11/2007 | Oldfield | |

FOREIGN PATENT DOCUMENTS

| | | | |
|---|---|---|---|
| EP | 0335013 | A1 | 10/1989 |
| EP | 0727454 | A2 | 8/1996 |
| EP | 727454 | A2 * | 8/1996 |
| EP | 0767236 | A1 | 4/1997 |
| EP | 1369470 | A1 | 12/2003 |
| EP | 1752520 | A1 | 2/2007 |
| JP | 2007332134 | A * | 12/2007 |
| WO | WO 03/076555 | | 9/2003 |
| WO | WO 2008/081287 | | 7/2008 |

OTHER PUBLICATIONS

International Search Report dated Mar. 22, 2010 for PCT/GB2009/002765.

* cited by examiner

*Primary Examiner* — Taiwo Oladapo

(74) *Attorney, Agent, or Firm* — Jones Day

(57) ABSTRACT

Gear oil formulations comprising a gear oil and a film forming agent are disclosed. The film forming agent comprises a polymeric ester which is the reaction product of at least one polyfunctional alcohol, a dimer fatty acid, an optional aliphatic dicarboxylic acid having 5 to 18 carbon atoms and one or more ingredients to reduce the acid value of the polymeric ester to below 5 mgKOH/g with the resultant polymeric ester having a kinematic viscosity at 100° C. ranging from 400 to 5000 $mm^2/s$ and a weight average molecular weight ranging from 5000 to 20000. When used as an automotive gear oil formulation the specifications for API GL-4 gear oils are at least satisfied. Use of the gear oil formulation in manual transmissions, transfer cases and differentials and use of the gear oil formulation in an industrial gear suitable for lubricating spur, helical, bevel, worm and hypoid gears are disclosed. Methods of lubrication are also disclosed.

20 Claims, No Drawings

GEAR OIL ADDITIVE

CROSS REFERENCE TO RELATED APPLICATION

This application is the National Phase application of International Application No. PCT/GB2009/002765, filed Nov. 27, 2009, which designates the United States and was published in English. The foregoing related application, in its entirety, is incorporated herein by reference.

The present invention relates to gear oil formulations comprising a gear oil and a film forming agent. When used as an automotive gear oil formulation the specifications for API GL-4 gear oils are at least satisfied. Use of the gear oil formulation in manual transmissions, transfer cases and differentials and use of the gear oil formulation in an industrial gear suitable for lubricating spur, helical, bevel, worm and hypoid gears are disclosed. Methods of lubrication are also disclosed.

Economic and environmental demands on gear oils mean that such compositions are being constantly pushed to their performance limits. Therefore choice of the combination of base fluid and additive package is crucial.

In automotive gear oils one such trend is towards extending oil drain intervals therefore it is necessary to develop gear oil formulations that have greater resistance to oxidation. It is recognised that antioxidant technology can carry some of the burden of resisting oxidation but choice and design of base fluid and other additives can also provide beneficial oxidative stability. Extension of oil drain intervals also means that the gear oils must have low volatility to prevent premature fluid loss.

Automotive lubricants must also maintain their proper viscosity and resist shear-down. Gear oils, in particular long lived gear oils and manual transmission lubricants experience tremendous shearing forces.

These property requirements have already led to the increased use of synthetic base fluids, specifically polyalphaolefin (PAO) base fluids. These base fluids have been shown to give added wear protection, better thermal and oxidative stability and much reduced volatility when compared to mineral oil formulated base fluids. Examples include PAO2, PAO4, PAO6 and PAO8 themselves (typically having kinematic viscosities at 100° C. of 2, 4, 6 and 8 mm $s^{-1}$ respectively) or as mixtures and also with small amounts of higher PAOs, for example PAO40 and PAO100.

Higher molecular weight PAOs, for example PAO 40, PAO100, PAO1000, PAO3000 and combinations of such PAO are used as lubricity agents, in combination with the above PAO base fluids, where they form a thin film coating on the moving parts of the gears. However these higher molecular weight PAO are expensive to manufacture and currently there are limited commercial sources of these materials.

For many gears, both automotive and industrial, a cause of concern is micropitting of gear teeth. Micropitting is surface fatigue occurring in Hertzian contacts caused by cyclic contact stresses and plastic flow on the asperity scale. It results in microcracking, formation of micropits and loss of material. It occurs under elastohydrodynamic lubrication (EHL) oil films where the film thickness is of the same order as composite surface roughness, and the load is borne by surface asperities and lubricant. When a significant portion of load is carried by asperities, collisions between asperities on opposing surfaces cause elastic or plastic deformation depending on local loads. Micropitting is recognised as damaging to gear tooth accuracy and in some cases can be a mode of primary gear failure. It is particularly seen as an issue for windmill gear boxes.

Investigations undertaken by the inventors have led to the identification of a polymeric ester (also known as a complex ester) which is suitable to be used as a film forming agent in both automotive and industrial gear oil formulations. The film forming agent of the invention has been found to provide good film thickness coverage at low speeds, has superior lubricity and has enhanced shear stability as compared to the known PAO additives. Furthermore it provides an enhanced boast to the viscosity index of the gear oil formulation as compared to some of the known PAO additives. The film forming agent also provides beneficial oxidative stability to the gear oil formulation. The gear oil formulation has improved low temperature properties when compared to use of the known PAO additives.

According to the present invention, a gear oil formulation comprising a gear oil and a film forming agent comprising a polymeric ester which is the reaction product of (a) at least one polyfunctional alcohol;
(b) a dimer fatty acid
(c) an optional aliphatic dicarboxylic acid having 5 to 18 carbon atoms; and
(d) one or more ingredients to reduce the acid value of the polymeric ester to below 5 mgKOH/g with the resultant polymeric ester having a kinematic viscosity at 100° C. ranging from 400 to 5000 $mm^2/s$ and a weight average molecular weight ranging from 5000 to 20000.

The Gear Oil

The gear oils may be either automotive or industrial gear oils. Automotive gear oils include those suitable for use in manual transmissions, transfer cases and differentials which all typically use a hypoid gear. By transfer case we mean a part of a four wheel drive system found in four wheel drive and all wheel drive systems. It is connected to the transmission and also to the front and rear axles by means of driveshafts. It is also referred to in the literature as a transfer gearcase, transfer gearbox, transfer box or jockey box. Industrial gear oils include those suitable for use with spur, helical, bevel, hypoid and worm gears. Specifically included are those suitable for use in windmill gear boxes which typically have helical gears.

Automotive gear oils will normally have a viscosity in the range of SAE 50 to SAE 250, and more usually will range from SAE 70W to SAE 140. Suitable automotive base oils also include cross-grades such as 75W-140, 80W-90, 85W-140, 85W-90, and the like. Automotive gear oils are classified by the American Petroleum Institute (API) using GL ratings. API classification subdivides all transmission oils into 6 classes as follows API GL-1, oils for light conditions. They consist of base oils without additives. Sometimes they contain small amounts of antioxidizing additives, corrosion inhibitors, depresants and antifoam additives. API GL-1 oils are designed for spiral-bevel, worm gears and manual transmissions without synchronizers in trucks and farming machines.

API GL-2, oils for moderate conditions. They contain antiwear additives and are designed for worm gears. Recommended for proper lubrication of tractor and farming machine transmissions.

API GL-3, oils for moderate conditions. Contain up to 2.7% antiwear additives. Designed for lubricating bevel and other gears of truck transmissions. Not recommended for hypoid gears.

API GL-4, oils for various conditions—light to heavy. They contain up to 4.0% effective antiscuffing additives. Designed for bevel and hypoid gears which have small displacement of axes, the gearboxes of trucks, and axle units. Recommended for non-synchronized gearboxes of US trucks, tractors and buses and for main and other gears of all vehicles. These oils are basic for synchronized gearboxes, especially in Europe.

API GL-5, oils for severe conditions. They contain up to 6.5% effective antiscuffing additives. The general application of oils in this class are for hypoid gears having significant displacement of axes. They are recommended as universal oils to all other units of mechanical transmission (except gearboxes). Oils in this class, which have special approval of vehicle manufacturers, can be used in synchronized manual gearboxes only. API GL-5 oils can be used in limited slip differentials if they correspond to the requirements of specification MIL-L-2105D or ZF TE-ML-05. In this case the designation of class will be another, for example API GL-5+ or API GL-5 LS.

API GL-6, oils for very heavy conditions (high speeds of sliding and significant shock loadings). They contain up to 10% high performance antiscuffing additives. They are designed for hypoid gears with significant displacement of axes. Class API GL-6 is not applied any more as it is considered that class API GL-5 well enough meets the most severe requirements.

Most modern gearboxes require a GL-4 oil, and separate differentials (where fitted) require a GL-5 oil.

Industrial gear oil specifications are governed primarily by American Gear Manufacturers Association (AGMA) in North America or by individual manufacturers themselves. A typical specification for American industrial gear oils is shown below in Table One.

TABLE ONE

AGMA 9005-D94-Viscosity ranges for AGMA lubricants

| AGMA lubricant number-Rust and oxidation inhibited gear oils | Viscosity range ($mm^2/s$ at 40° C.) | Equivalent ISO grade | AGMA lubricant number-Extreme pressure gear lubricants |
|---|---|---|---|
| 1 | 41.4 to 50.6 | 46 | |
| 2 | 61.2 to 74.8 | 68 | 2 EP |
| 3 | 90 to 110 | 100 | 3 EP |
| 4 | 135 to 165 | 150 | 4 EP |
| 5 | 198 to 242 | 220 | 5 EP |
| 6 | 288 to 352 | 320 | 6 EP |
| 7-compounded with 3-10% fatty or synthetic fatty oils | 414 to 506 | 460 | 7 EP |
| 8-compounded | 612 to 748 | 680 | 8 EP |
| 8A-compounded | 900 to 1100 | 1000 | 8A EP |

In Europe, as well as most of the Rest of the World, industrial gear oil specifications are typically written by Deutches Institut fur Normung (DIN).

The gear oils in which the compositions of this invention are employed can be based on natural or synthetic oils, or blends thereof, provided the lubricant has a suitable viscosity for use in gear oil applications. The gear oils for such use can be mineral oil base stocks such as for example conventional and solvent-refined paraffinic neutrals and bright stocks, hydrotreated paraffinic neutrals and bright stocks, naphthenic oils, cylinder oils, etc., including straight run and blended oils. Synthetic base stocks can also be used in the practice of this invention, such as for example PAO, alkylated aromatics, polybutenes, diesters, polyol esters, polyglycols, polyphenyl ethers, etc., and blends thereof. It is also known for PAOs and esters to be blended with mineral oils to form semi synthetics. Synthetic base stocks are preferred, especially base stocks having PAO or mixtures of PAOs as a major component.

At Least One Polyfunctional Alcohol

The at least one polyfunctional alcohol is preferably a polyol. The polyol preferably is of formula R(OH)n where n is an integer, which ranges from 2-10 and R is a hydrocarbon chain, either branched or linear, more preferably branched, of 2 to 15 carbon atoms. The polyol is suitably of low molecular weight, preferably in the range from 50 to 650, more preferably 60 to 150, and particularly 60 to 100. Examples of suitable polyols include ethylene glycol, propylene glycol, trimethylene glycol, diols of butane, neopentyl glycol, trimethyol propane and its dimer, pentaerythritol and its dimer, glycerol, inositol and sorbitol. Preferably the polyol is a neopentyl polyol. Preferred examples of neopentyl polyols are neopentyl glycol, trimethylol propane and pentaerythritol. Preferably the neopentyl polyol comprises at least 50% by weight of neopentyl glycol, more preferably at least 70%, even more preferably at least 90%.

Dimer Fatty Acid

The term dimer fatty acid is well known in the art and refers to the dimerisation product of mono- or polyunsaturated fatty acids and/or esters thereof. Preferred dimer fatty acids are dimers of C10 to C30, more preferably C12 to C24, particularly C14 to C22, and especially C18 alkyl chains. Suitable dimer fatty acids include the dimerisation products of oleic acid, linoleic acid, linolenic acid, palmitoleic acid, and elaidic acid with oleic acid being particularly preferred. The dimerisation products of the unsaturated fatty acid mixtures obtained in the hydrolysis of natural fats and oils, e.g. sunflower oil, soybean oil, olive oil, rapeseed oil, cottonseed oil and tall oil, may also be used. These dimer fatty acids have iodine values typically of at least 100, measured according to a test method equivalent to ASTM D1959-85. Hydrogenated, for example by using a nickel, platinum or palladium catalyst, dimer fatty acids may also be employed. These hydrogenated dimer fatty acids have iodine values less than 25, preferably less than 20, more preferably less than 15, especially less than 10.

Hydrogenated dimer acids are especially preferred for use in the present invention.

In addition to the dimer fatty acids, dimerisation usually results in varying amounts of oligomeric fatty acids (so-called "trimer") and residues of monomeric fatty acids (so-called "monomer"), or esters thereof, being present. The amount of monomer and trimer can, for example, be reduced by distillation. Particularly preferred dimer fatty acids used in the present invention, have a dimer content of greater than 50%, more preferably greater than 70%, particularly greater than 85%, and especially greater than 90% by weight. The trimer content is preferably less than 50%, more preferably in the range from 1 to 20%, particularly 2 to 10%, and especially 3 to 6% by weight. The monomer content is preferably less than 5%, more preferably in the range from 0.1 to 3%, particularly 0.3 to 2%, and especially 0.5 to 1% by weight.

Whilst it is desirable for the polymeric ester to have some polarity, it is recognised that too high a polarity can lead to undesirable effects such as seal swell and/or too high surface affinity which could cause antagonistic interactions with inorganic antiwear additives also present in the gear oil formulation. Non-polarity index, NPI is one method of assessing polarity and is defined as total number of carbon atoms * molecular weight
number of carboxylate groups×100

The NPI of the film forming agent is between 1000 and 4000, preferably between 1500 and 3000.

Optionally an Aliphatic Dicarboxylic Acid

An aliphatic dicarboxylic acid may be used to optimise the polarity of the polymeric ester. Examples of suitable aliphatic dicarboxylic acids include glutaric, adipic, pimelic, suberic, azelaic, sebacic, undecanedioic, dodecanedioic, tridecanedioic, tetradecanedioic, pentadecanedioic, hexadecanedioic acids and mixtures thereof. The aliphatic dicarboxylic acid preferably has from 7 to 16 carbon atoms, more preferably from 8 to 14 carbon atoms. The aliphatic dicarboxylic acid is preferably linear. Azelaic acid, sebacic acid and dodecanedioic acid are particularly preferred. Azelaic acid is especially preferred.

One or More Ingredients to Reduce the Acid Value of the Polymeric Ester to Below 5 mgKOH/q Examples of such an ingredient include an aliphatic monocarboxylic acid having 5 to 24 carbon atoms or an aliphatic monofunctional alcohol having 5 to 24 carbon atoms. The monoacid or monoalcohol reacts with any OH or COOH groups respectively which remain unreacted after reaction between the polyfunctional alcohol and the dimer fatty acid. Examples of the aliphatic monocarboxylic acid include the saturated straight chained acids of pentanoic, hexanoic, heptanoic, octanoic, nonanoic, decanoic, undecanoic, dodecanoic, tridecanoic, tetradecanoic, pentadecanoic, hexadecanoic, heptadecanoic, octadecanoic, arachidic, behenic and lignoceric acids and mixtures thereof. Examples also include unsaturated and/or branched variants of the disclosed saturated, straight-chained acids. The aliphatic monocarboxylic acid preferably has 7 to 20 carbon atoms, more preferably 8 to 18 carbon atoms. It may be branched or straight chained and preferably is saturated. Particularly preferred monoacids are a mixture of octanoic and decanoic acids, and isostearic acid.

Examples of the aliphatic monofunctional alcohol include pentanol, hexanol, heptanol, octanol, nonanol, decanol, undecanol, dodecanol, tridecanol, tetradecanol, pentadecanol, hexadecanol, heptadecanol, octadecanol and mixtures thereof. Examples also include unsaturated and/or branched variants of the disclosed saturated, straight chained acids The aliphatic monofunctional alcohol preferably has 7 to 16 carbon atoms, more preferably 8 to 14 carbon atoms. It may be branched or straight chained and preferably is saturated. 2-Ethylhexanol is particularly preferred.

A further example of such an ingredient is an acid catcher, for example a glycidyl ester.

The one or more further ingredient may be added to the reaction mixture at the same time as a), b) and optionally c) or after reaction of a), b) and optionally c) has completed.

Preferably the acid value is reduced to below 1 mgKOH/g, more preferably below 0.5 mgKOH/g and especially below 0.2 mgKOH/g The resulting polymeric ester has a kinematic viscosity at 100° C. of 400 to 5000, preferably 500 to 3000, more preferably 500 to 2500, especially 500-2200 $mm^2/s$.

The polymeric ester has a weight average molecular weight between 5000 and 20000. A weight average molecular weight of below 5000 is deemed unsuitable with respect to the ability of the film forming agent to reliably form a film. A polymeric ester with a weight average molecular weight above 20000 is deemed unsuitable to meet the needs of the present invention because it is believed that such a high molecular weight will not have the required shear stability. The polymeric ester preferably has a weight average molecular weight range of 5000 to 18000, more preferably 5000 to 17000 and especially 5000 to 15000. In cases where the polymeric ester has a high molecular weight (typically above 13000) a lower molecular weight ester, for example a diester or a polyol ester, may need to be added to the gear oil formulation to ensure that the polymeric ester is fully soluble in the gear oil. A suitable example of such a cosolvent is Priolube™ 3970 available ex Croda Europe Ltd. The dose rate of the lower molecular weight ester is chosen such that the polymeric ester is fully soluble but also that the overall polarity of the esters is suitable so as to not lead to undesirable effects as detailed above.

The polymeric ester suitably has an iodine value less than 50, more preferably less than 35, even more preferably less than 25, especially less than 15 and more especially less than 10. Iodine value analysis was carried out following a test method equivalent to ASTM D1959-85.

Preferred film forming agents include a polymeric ester which is the reaction product of a polyol, preferably a neopentyl polyol, more preferably neopentylglycol with dimer acid, preferably hydrogenated dimer acid, and then end capped with a monoalcohol, preferably 2-ethyl hexanol.

The film forming agent may further comprise a second ester which is the reaction product of at least one polyfunctional alcohol and a dimer fatty acid with the resultant ester having a kinematic viscosity at 100° C. ranging from 20 to 100 $mm^2/s$. Preferably the polyfunctional alcohol for this second ester is a diol, specifically ethylene glycol. The dimer fatty acid for this second ester may be unhydrogenated or hydrogenated. Preferably it is hydrogenated.

Preferably the ratio of the polymeric ester to the second ester is in the range of 5:1 to 1:5, more preferably 3:2 to 2:3.

The Gear Oil Formulation

For automotive gear oils the gear oil formulation at least satisfies the requirements of GL-4 rating classification of the American Petroleum Institute.

Gear oil formulations of the invention preferably exhibit a percentage viscosity loss, measured using a modified version of CEC L-40-A-93, over a 20 hour period of less than 20%, more preferably less than 10% and especially less than 5%. Gear oil formulations of the invention preferably exhibit a percentage viscosity loss, measured using a modified version of CEC L-40-A-93, over a 100 hour period of less than 25%, more preferably less than 20% and especially less than 15%.

When the film thickness of the gear oil formulation falls below the level of the highest asperity on the gear surface then wear occurs. Such poor film thickness is known to occur under low speed and/or high load conditions. Therefore formation of a good film thickness at a low speed is advantageous in preventing wear. The film forming agent is of the invention preferably forms a film thickness of 5 nm at speeds of less than 0.04 $m\ s^{-1}$, more preferably less than 0.025 $m\ s^{-1}$ High frequency friction reciprocating testing (HFRR) is a recognised screening tool for wear evaluation. A wear scar of less than 600 μm, preferably less than 550 μm, more preferably less than 500 μm and especially less than 450 μm measured using HFRR according to CEC F-06-A-96 is obtained when the gear oil formulation is used.

The film forming additive also acts as a viscosity index improver. The film forming additive provides a viscosity index boost to the gear oil formulation of at least 40%, preferably at least 55%, more preferably at least 65%, especially at least 70%.

Gear oil formulations according to the invention have good low temperature properties. The viscosity of such formulations at −35° C. is less than 120,000 centapoise (cP), more preferably less than 100,000 cP, especially less than 90,000 cP.

To obtain surface effects only, for example film thickness enhancement, the film forming agent is preferably present at levels between 0.3 to 2% by weight, preferably 0.4 to 1% by weight, especially 0.5% by weight.

To also obtain bulk effects, for example oxidative stability, shear stability and boost of viscosity index the film forming agent is preferably present at levels between 3 and 50% by weight, more preferably between 5 and 35% and especially between 5 and 25% in the gear oil formulation.

The gear oil formulation may further comprise an antioxidant preferably in the range 0.2 to 2%, more preferably 0.4 to 1% by weight. Antioxidants include hindered phenols, alkyl diphenylamines and derivatives and phenyl alpha naphthylamines and derivatives of. Especially preferred antioxidants are Irganox™ L57 and Irganox™ L06 available ex Ciba. Gear oil formulations with the presence of the antioxidant preferably exhibit a percentage viscosity loss, measured using a modified version of CEC L-40-A-93, over a 100 hour period of less than 20%, more preferably less than 15% and especially less than 10%.

Other additives may be present in the gear oil formulation of known functionality at levels between 0.01 to 30%, more preferably between 0.01 to 20% more especially between 0.01 to 10% of the total weight of the gear oil formulation. These can include detergents, extreme pressure/antiwear additives, dispersants, corrosion inhibitors, rust inhibitors, friction modifiers, foam depressants, pour point depressants, and mixtures thereof. Extreme pressure/antiwear additives include ZDDP, tricresyl phosphate, amine phosphates. Corrosion inhibitors include sarcosine derivatives, for example Crodasinic O available from Croda Europe Ltd. Foam depressants include silicones and organic polymers. Pour point depressants include polymethacrylates, polyacrylates, polyacrylamides, condensation products of haloparaffin waxes and aromatic compounds, vinyl carboxylate polymers, terpolymers of dialkylfumarates, vinyl esters of fatty acids and alkyl vinyl ethers. Ashless detergents include carboxylic dispersants, amine dispersants, Mannich dispersants and polymeric dispersants. Friction modifiers include amides, amines and partial fatty acid esters of polyhydric alcohols. Ash-containing dispersants include neutral and basic alkaline earth metal salts of an acidic organic compound. Additives may include more than one functionality in a single additive.

According to a further embodiment of the present invention use of the above mentioned gear oil formulation in a machine such as a manual transmission, a transfer case and/or a differential.

According to a further embodiment of the present invention use of the gear oil formulation in an industrial gear.

According to a further embodiment of the present invention use of the gear oil formulation in a windmill gear box.

According to a further embodiment a method of lubricating a machine such as a manual transmission, a transfer case and/or a differential.

According to a further embodiment a method of lubricating an industrial gear.

According to a further embodiment use of the film forming agent to increase shear stability, lubricity and/or viscosity index of the gear oil formulation.

The invention will now be described further by way of example only with reference to the following Examples.

EXAMPLE ONE

Shear stability testing was carried out according to CEC L-40-A-93 modified in that a smaller pot was used. The test conditions were:

Start temperature 60° C.

1450 revolutions per minute

50 Kg load 20 or 100 hours run time 20 g sample

Table Two illustrates percentage viscosity loss after both 20 and 100 hours for 75W-140 gear oil formulations with PAO6 gear oil and Priolube™ 3970 as solubilising agent for film forming agent in gear oil formulation containing esters of the current invention and comparative esters.

TABLE TWO

| Film forming agent (% by wt) | PAO6 Gear oil (% by wt) | P3970 Solubilising agent for film forming agent in base fluid (% by wt) | Viscosity loss after 20 hours (% by wt) | Viscosity loss after 100 hours (% by wt) |
|---|---|---|---|---|
| Ester A (24) | 45 | 31 | 4.5 | 20.9 |
| Ester B (25) | 58 | 17 | 1.4 | 11.1 |
| Ester A (17)/ Ester C (17) | 15 | 51 | 2.8 | Not measured |
| Ester A (17)/ Ester D (17) | 15 | 51 | 3.7 | Not measured |
| Ester B (17)/ Ester C (17) | 15 | 51 | 2.2 | Not measured |
| Ester B (17)/ Ester D (17) | 15 | 51 | 4.2 | Not measured |
| PAO1000 (23)-comparative | 77 | 0 | 20.0 | Not measured |
| PAO3000 (17)-comparative | 83 | 0 | 28.6 | Not measured |

Ester A according to the invention is the reaction product of neopentylglycol (167 kg) with dimer acid with at least 95% dimer present (833 kg) and C9 dicarboxylic acid (12.5 kg). 5% w/w Cardura™ E10 was then added to reduce acid value. The ester has a viscosity at 100° C. of about 1800 $mm^2/s$. The ester has an NPI of 2624 and an iodine value of 33 g/100 g.

Ester B according to the invention is the reaction product of neopentylglycol (167 kg) with hydrogenated dimer acid with at least 95% dimer present (833 kg). 5% w/w Cardura™ E 10 was then added to reduce acid value. The ester has a viscosity at 100° C. of about 1600 $mm^2/s$. The ester has an iodine value of 4.3 g/100 g.

Ester C according to the invention is the reaction product of monoethylene glycol (>2 mol) with dimer acid with at least 65% dimer present (1 mol). The ester has a viscosity at 100° C. of about 60 $mm^2/s$.

Ester D according to the invention is the reaction product of monoethylene glycol (>2 mol) with hydrogenated dimer acid with at least 65% dimer present (1 mol). The ester has a viscosity at 100° C. of about 60 $mm^2/s$.

The results in the Table clearly show that gear oil formulations comprising a film forming agent according to the present invention have a much lower viscosity loss after 20 hours and are therefore more shear stable than gear oil formulations having PAO1000 or PAO3000 additives. Therefore they are more suitable for use in gear oil formulation which are known to be subject to extensive shear forces. Furthermore the results after 100 hours show that the gear oil formulations of the invention still maintain a low viscosity loss.

EXAMPLE TWO

Table Three illustrates percentage viscosity loss after 100 hours for the 75W-140 gear oil formulations containing polymeric esters of the current invention as per Example One with further addition of 0.5% by weight of Irganox™ L57 antioxidant available ex Ciba.

TABLE THREE

| Film forming agent (% by wt) | Gear Oil (% by wt) | Solubilising agent for film forming agent in base fluid (% by wt) | Antioxidant (% by wt) | Viscosity loss after 100 hours (% by wt) |
|---|---|---|---|---|
| Ester A (24) | 45 | 30.5 | 0.5 | 17.7 |
| Ester A (24) | 45 | 30.5 | Not present | 20.9 |
| Ester B (25) | 58 | 16.5 | 0.5 | 7.5 |
| Ester B (25) | 58 | 16.5 | Not present | 11.1 |

It can be seen that the presence of the antioxidant further reduces the percentage viscosity loss.

EXAMPLE THREE

Table four illustrates size of wear test scar measured for 150 ppm (wt/wt) solutions of polymeric esters of the current invention and comparative esters in ultra low sulphur diesel (ULSD). The wear scar size in μm was measured using a high frequency reciprocating rig (HFRR) under test conditions according to EN590, CEC-0-A-96.

TABLE FOUR

| film forming agent | Wear scar (μm) |
|---|---|
| Ester A | Typically 500 to 550 |
| Ester B | 414 |
| PAO100-comparative | 671 |
| PAO1000-comparative | 632 |
| PAO3000-comparative | 668 |

The results show that a ULSD formulation comprising a film forming agent according to the invention has a wear test scar less than that comprising comparative materials.

EXAMPLE FOUR

Film thickness was measured, using principle of optical interferometry, on a PCS Instruments ultra thin film rig with a silica coated glass disc positioned above a loaded ball in the gear oil formulation for a variety of speeds.

Temperature 40° C.

Load 50N

Speeds 4 m/s to 0.004 m/s

Gear oil—PAO 2 with viscosity of ~2.6 $mms^{-1}$ at 100° C.

Table Five illustrates speed at which two specific film thicknesses were formed for these gear oil formulations including film forming agents of the invention and for comparators.

TABLE FIVE

| | Speed in $ms^{-1}$ at specific film thickness | |
|---|---|---|
| film forming agent | 5 nm thickness | <63 nm thickness |
| Ester A (5% by wt in PAO2) | 0.0218 | 0.853 |
| Ester B (5.5% by wt in PAO2) | 0.0112 | 0.853 |
| PAO 100 - comparative (10% by wt in PAO2) | 0.0580 | 1.194 |

Table Six shows film thickness obtained at a specific low speed, 0.057 $ms^{-1}$ for a film forming agent according to the invention and a comparator.

TABLE SIX

| film forming agent | specific film thickness in nm at 0.057 $ms^{-1}$ |
|---|---|
| Ester A (5% by wt in PAO2) | 18.6 |
| Ester B (5.5% by wt in PAO2) | 8.1 |
| PAO 100 - comparative (10% by wt in PAO2) | 6.5 |

The data in Tables Five and Six shows that use of a film forming agent according to the invention in a gear oil formulation leads to quicker formation of film thickness, i.e. there is good film thickness at low speeds which helps reduce wear. It is postulated that such film thickness will reduce surface fatigue in the gears therefore helping to reduce micropitting.

EXAMPLE FIVE

Table Seven shows the viscosity index boost for 75W-140 gear oil formulations as according to the invention and comparators. Kinematic viscosity measurements were undertaken using Anton Paar Viscometer SVM 3000. For Ester A the viscosity at 40° C. was too high to take a measurement. Therefore the viscosity was measured at 80° C. and 100° C. and both 40° C. viscosity and VI were then calculated from these measurements using ASTM D2270. The gear oil used was PAO2 with a VI of 124.

TABLE SEVEN

| Film forming agent (% by wt) | Gear Oil (% by wt) | Viscosity Index of gear oil formulation | % VI boost |
|---|---|---|---|
| Ester A (10) | PAO2 (90) | 217 | 75 |
| PAO100 (10)-comparative | PAO2 (90) | 153 | 23 |
| PAO1000 (10)-comparative | PAO2 (90) | 237 | 91 |

The data in Table Seven illustrates the VI boost provided by a film forming agent of the invention. It is to be noted that PAO1000 itself provides a larger VI boost BUT it does not have all the other properties as according to the invention.

EXAMPLE SIX

Table Eight shows the viscosity at −35° C. for 75W-140 gear oil formulations as according to the invention, measured using a Brookfield cold crank simulator

TABLE EIGHT

| Film forming agent (% by wt) | Gear Oil (% by wt) | Solubilising agent (P3970) for film forming agent in base fluid (% by wt) | Viscosity (cP) |
|---|---|---|---|
| Ester A (31) | PAO4 (38) | 31 | 82,500 |
| PAO100 (59)-comparative | PAO6 (41) | Not present | 134,316 |

The data in Table Eight illustrates that a gear oil formulation according to the invention has a low viscosity at a low temperature, −35° C. This is important for cold start.

EXAMPLE SEVEN

Oxidative stability of film forming agents according to the invention and comparators was measured using a modified version of hot tube test, IP 280/85.

The duration of the test was 168 hours in which air was blown through a first tube, containing a steel coupon and gear oil formulation at 140° C., followed by a second tube containing water at room temperature.

Coupon loss in g, volatile acid in the water (mg KOH/g) and net acid increase of the gear oil formulation were measured.

Table Nine shows the oxidative stability for film forming agents according to the invention in PAO 6 gear oil.

TABLE NINE

| Film forming agent (% by wt) | PAO6 Gear oil (% by wt) | P3970 Solubilising agent for film forming agent in base fluid (% by wt) | mg KOH/g |
|---|---|---|---|
| Ester A 22.5 | 55 | 22.5 | 3.0-4.0 (testing of various batches) |
| Ester B 22.5 | 55 | 22.5 | 1.3 |
| PAO1000-comparative 25.9 | 74.1 | Not applicable | 0.1 |

As can be seen film forming agents according to the invention provide oxidative stability. PAO1000 itself provides enhanced oxidative stability BUT does not have the other properties as required according to the invention.

The invention claimed is:

1. A gear oil formulation, comprising:

i) a gear oil; and ii) a film forming agent comprising a polymeric ester which is the reaction product of:

a) at least one neopentyl polyol;

b) a hydrogenated dimer fatty acid having an iodine value of less than 25;

c) an optional aliphatic dicarboxylic acid having 5 to 18 carbon atoms; and d) one or more ingredients to reduce the acid value of the polymeric ester to below 5 mgKOH/g;

with the resultant polymeric ester having a kinematic viscosity at 100° C. ranging from 400 to 5000 $mm^2/s$ and a weight average molecular weight ranging from 5000 to 20000.

2. A gear oil formulation, comprising:

i) a gear oil; and ii) a film forming agent comprising a polymeric ester which is the reaction product of:

a) at least one neopentyl polyol;

b) a hydrogenated dimer fatty acid having an iodine value of less than 25;

c) an aliphatic dicarboxylic acid having 5 to 18 carbon atoms; and d) one or more ingredients to reduce the acid value of the polymeric ester to below 5 mgKOH/g;

with the resultant polymeric ester having a kinematic viscosity at 100° C. ranging from 400 to 5000 $mm^2/s$ and a weight average molecular weight ranging from 5000 to 20000.

3. The gear oil formulation of claim 1, wherein the film forming agent has a non-polarity index of between 1000 and 4000.

4. The gear oil formulation of claim 1, wherein the film forming agent has a non-polarity index of between 1500 and 3000.

5. The gear oil formulation of claim 1, wherein the one or more ingredients to reduce the acid value of the polymeric ester to below 5 mgKOH/g is either an aliphatic monocarboxylic acid having 5 to 24 carbon atoms or an aliphatic monofunctional alcohol having 5 to 24 carbon atoms.

6. The gear oil formulation of claim 1, wherein the one or more ingredients to reduce the acid value of the polymeric ester to below 5 mgKOH/g is an acid catcher.

7. The gear oil formulation of claim 1, wherein the acid value of the polymeric ester is reduced to below 1 mgKOH/g.

8. The gear oil formulation of claim 1, wherein the acid value of the polymeric ester is reduced to below 0.5 mgKOH/g.

9. The gear oil formulation of claim 1, wherein the acid value of the polymeric ester is reduced to below 0.2 mgKOH/g.

10. The gear oil formulation of claim 1, wherein the resultant polymeric ester has a kinematic viscosity at 100° C. ranging from 500 to 3000 $mm^2/s$.

11. The gear oil formulation of claim 1, wherein the resultant polymeric ester has a kinematic viscosity at 100° C. ranging from 500 to 2500 $mm^2/s$.

12. The gear oil formulation of claim 1, wherein the resultant polymeric ester has a kinematic viscosity at 100° C. ranging from 500 to 2200 $mm^2/s$.

13. The gear oil formulation of claim 1, wherein the resultant polymeric ester has a weight average molecular weight between 5000 to 18000.

14. The gear oil formulation of claim 1, wherein the resultant polymeric ester has a weight average molecular weight between 5000 to 17000.

15. The gear oil formulation of claim 1, wherein the resultant polymeric ester has a weight average molecular weight between 5000 to 15000.

16. The gear oil formulation of claim 1, wherein the film forming agent increases shear stability, lubricity and/or viscosity index of said gear oil formulation.

17. A method of increasing shear stability, lubricity, and/or viscosity index of a gear oil formulation, comprising adding a film forming agent to the gear oil formulation;

wherein the film forming agent comprises a polymeric ester which is the reaction product of:

a) at least one neopentyl polyol;

b) a hydrogenated dimer fatty acid having an iodine value of less than 25;

c) an aliphatic dicarboxylic acid having 5 to 18 carbon atoms; and d) one or more ingredients to reduce the acid value of the polymeric ester to below 5 mgKOH/g;

with the resultant polymeric ester having a kinematic viscosity at 100° C. ranging from 400 to 5000 $mm^2/s$ and a weight average molecular weight ranging from 5000 to 20000.

18. A method of lubricating a machine, comprising using the gear oil formulation of claim 1;

wherein the machine comprises a manual transmission, a transfer case, or a differential.

19. A method of lubricating an industrial gear, comprising using the gear oil formulation of claim 1.

20. A method of lubricating a windmill gear box, comprising using the gear oil formulation of claim 1.

* * * * *